US010526907B2

(12) United States Patent
Blais et al.

(10) Patent No.: US 10,526,907 B2
(45) Date of Patent: Jan. 7, 2020

(54) INTERNALLY COOLED SEAL RUNNER

(71) Applicant: PRATT & WHITNEY CANADA CORP., Longueuil (CA)

(72) Inventors: Daniel Blais, St-Jean-sur-Richelieu (CA); Alain Lewis, Brossard (CA); Alain C. Martel, St-Paul d'Abbotsford (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 330 days.

(21) Appl. No.: 15/469,619

(22) Filed: Mar. 27, 2017

(65) Prior Publication Data

US 2017/0198598 A1 Jul. 13, 2017

Related U.S. Application Data

(63) Continuation of application No. 13/917,075, filed on Jun. 13, 2013, now Pat. No. 9,631,508.

(51) Int. Cl.

| | |
|---|---|
| ***F01D 25/12*** | (2006.01) |
| ***F01D 11/02*** | (2006.01) |
| ***F01D 11/00*** | (2006.01) |

(52) U.S. Cl.

CPC ..... *F01D 11/02* (2013.01); *F01D 11/00* (2013.01); *F01D 11/003* (2013.01); *F01D 25/12* (2013.01); *F05D 2260/232* (2013.01)

(58) Field of Classification Search

CPC ..... F01D 11/02; F01D 11/00; F01D 11/003; F01D 25/12; F01D 25/18; F01D 25/183; F05D 2240/55; F05D 2240/57; F05D 2260/232; F16J 15/34; F16J 15/3404; F16J 15/3464

See application file for complete search history.

(56) References Cited

U.S. PATENT DOCUMENTS

| | | | | |
|---|---|---|---|---|
| 2,956,824 | A * | 10/1960 | Kuchler | F01D 11/003 277/500 |
| 2,992,842 | A | 7/1961 | Shevchenko et al. | |
| 3,915,521 | A | 10/1975 | Young | |
| 4,086,759 | A | 5/1978 | Karstensen et al. | |
| 4,406,459 | A | 9/1983 | Davis et al. | |
| 4,465,427 | A | 8/1984 | Libertini et al. | |
| 4,648,485 | A | 3/1987 | Kovaleski | |
| 4,683,714 | A | 8/1987 | Thebert | |
| 4,969,652 | A | 11/1990 | Munson | |
| 5,301,957 | A | 4/1994 | Hwang et al. | |
| 5,558,341 | A | 9/1996 | McNickle et al. | |
| 5,568,984 | A | 10/1996 | Williams | |
| 5,593,165 | A | 1/1997 | Murray et al. | |
| 5,639,096 | A | 6/1997 | Ullah | |
| 5,813,830 | A | 9/1998 | Smith et al. | |
| 6,145,843 | A | 11/2000 | Hwang | |
| 6,996,968 | B2 | 2/2006 | Peters et al. | |

(Continued)

*Primary Examiner* — Dwayne J White
*Assistant Examiner* — Danielle M. Christensen
(74) *Attorney, Agent, or Firm* — Norton Rose Fulbright Canada LLP

(57) ABSTRACT

A contact seal assembly for a shaft of a gas turbine engine includes a seal runner adapted to be connected to the shaft and rotatable relative to a carbon ring. The seal runner includes concentric inner and outer annular portions radially spaced apart to define at least one internal fluid passage between the inner and outer annular portions of the seal runner.

17 Claims, 6 Drawing Sheets

(56) References Cited

U.S. PATENT DOCUMENTS

| | | | |
|---|---|---|---|
| 7,252,291 | B2 | 8/2007 | Khonsari et al. |
| 7,410,341 | B2 | 8/2008 | Gockel et al. |
| 7,699,530 | B2 | 4/2010 | Blais |
| 7,905,495 | B2 | 3/2011 | Munson |
| 8,678,741 | B2 | 3/2014 | Olennikov et al. |
| 8,845,282 | B2 | 9/2014 | Lapierre et al. |
| 8,945,284 | B2 | 2/2015 | Short et al. |
| 9,631,508 | B2 | 4/2017 | Blais et al. |
| 9,897,005 | B2 | 2/2018 | Chilton et al. |
| 9,944,399 | B2 | 4/2018 | Desjardins |
| 9,989,083 | B2 | 6/2018 | Labbe |
| 2004/0179935 | A1 | 9/2004 | Maguire |
| 2006/0037325 | A1 | 2/2006 | Peters et al. |
| 2006/0081419 | A1 | 4/2006 | Care et al. |
| 2014/0119887 | A1 | 5/2014 | Lyle et al. |
| 2014/0140824 | A1 | 5/2014 | Sheridan |
| 2014/0369832 | A1 | 12/2014 | Blais et al. |
| 2016/0040544 | A1 | 2/2016 | Desjardins |
| 2016/0348792 | A1 | 12/2016 | Labbe |

* cited by examiner

INTERNALLY COOLED SEAL RUNNER

CROSS-REFERENCE TO RELATED APPLICATIONS

The present application is a continuation of U.S. patent application Ser. No. 13/917,075 filed Jun. 13, 2013, the entire content of which is incorporated herein by reference.

TECHNICAL FIELD

The invention relates generally to gas turbine engines, and more particularly to seals for rotating components in a gas turbine engine.

BACKGROUND

Contact seals, often called carbon seals, are commonly used to provide a fluid seal around a rotating shaft, particularly high speed rotating shafts used in high temperature environments such as in gas turbine engines. Such contact seals usually comprise carbon ring segments and a seal runner which abut and rotate relative to each other form a rubbing interface which creates a fluid seal around the shaft. Typically, but not necessarily, the seal runner is disposed on the rotating shaft and rotates within an outer stationary carbon ring, causing the rubbing interface between the rotating seal runner and the rotationally-stationary carbon ring. This rubbing contact however generates significant heat, given the high rotational speeds of gas turbine engine shafts, which must be dissipated. This heat dissipation is most often accomplished using fluid cooling, for example oil from the engine's recirculating oil system which is sprayed onto the external surfaces of the seal runner and/or the carbon ring. However, this spray cooling limits the size envelope and configuration possible for shaft seal installations, and further, if inadequately cooling fluid is provided or the cooling fluid cannot sufficiently reach/cover the required surfaces, sealing performance of such shaft seals can degrade.

Accordingly, an improved shaft contact seal is sought.

SUMMARY

In one aspect, there is provided a contact seal assembly for a shaft of a gas turbine engine, comprising: one or more carbon ring segments mounted in a fixed position within a housing; and an annular seal runner adapted to be connected to the shaft of the gas turbine engine and rotatable relative to the carbon ring segments, the seal runner being disposed adjacent to and radially inwardly from the carbon ring segments and abutting thereagainst during rotation of the seal runner to form a contact interface between the seal runner and the carbon ring segments which forms a substantially fluid tight seal; the seal runner comprising concentric inner and outer annular portions which are radially spaced apart to define therebetween at least one internal fluid passage, said fluid passage defining a tortuous fluid flow path through the fluid passage and being adapted to receiving cooling fluid therein for cooling the seal runner from within, and the seal runner having one or more oil scoops integrally formed in one of the inner and outer annular portions and disposed in fluid flow communication with the internal fluid passage, the oil scoop feeding cooling oil into said fluid passage.

In another aspect, there is provided a gas turbine engine comprising one or more compressors, a combustor and one or more turbines, at least one of said compressors and at least one of said turbines being interconnected by an engine shaft rotating about a longitudinal axis thereof, at least one contact shaft seal being disposed about the rotating engine shaft to provide a fluid seal therewith, the contact shaft seal comprising one or more carbon ring assemblies having carbon ring segments mounted in a fixed position within a housing and an annular seal runner fixed to the engine shaft for rotation within the carbon ring assemblies, the seal runner abutting the carbon ring segments during rotation of the seal runner to form a contact interface therebetween which forms a substantially fluid tight shaft seal, the seal runner having concentric inner and outer annular portions which are radially spaced apart to define therebetween at least one internal fluid passage enclosed within the seal runner, the fluid passage defining a tortuous fluid flow path through the fluid passage and receiving cooling fluid therein for cooling the seal runner from within, the seal runner having one or more oil scoops integrally formed in one of the inner and outer annular portions and disposed in fluid flow communication with the internal fluid passage to feed cooling oil into said fluid passage.

In a further aspect, there is provided a method of cooling an annular seal runner of a shaft seal assembly having carbon ring segments abutting the seal runner during relative rotation therebetween to form a contact interface between an outer runner surface of the seal runner and an inner surface of the carbon ring segments to form a fluid seal around the shaft, the method comprising: providing the seal runner with an internal fluid passage disposed radially between inner and outer annular portions of the seal runner; using an oil scoop integrally formed in the seal runner to feed cooling oil into the internal fluid passage within the seal runner; and internally cooling at least a radially outer portion of the seal runner having the outer runner surface thereon by circulating the cooling oil through the internal fluid passage of the seal runner to cool the seal runner from within, including rotating the seal runner to collect the cooling oil using the oil scoop and force the flow of the cooling oil through the internal fluid passage.

Further details of these and other aspects of the present invention will be apparent from the detailed description and figures included below.

BRIEF DESCRIPTION OF THE DRAWINGS

Reference is now made to the accompanying figures depicting aspects of the present invention, in which.

DETAILED DESCRIPTION

Figure 1:
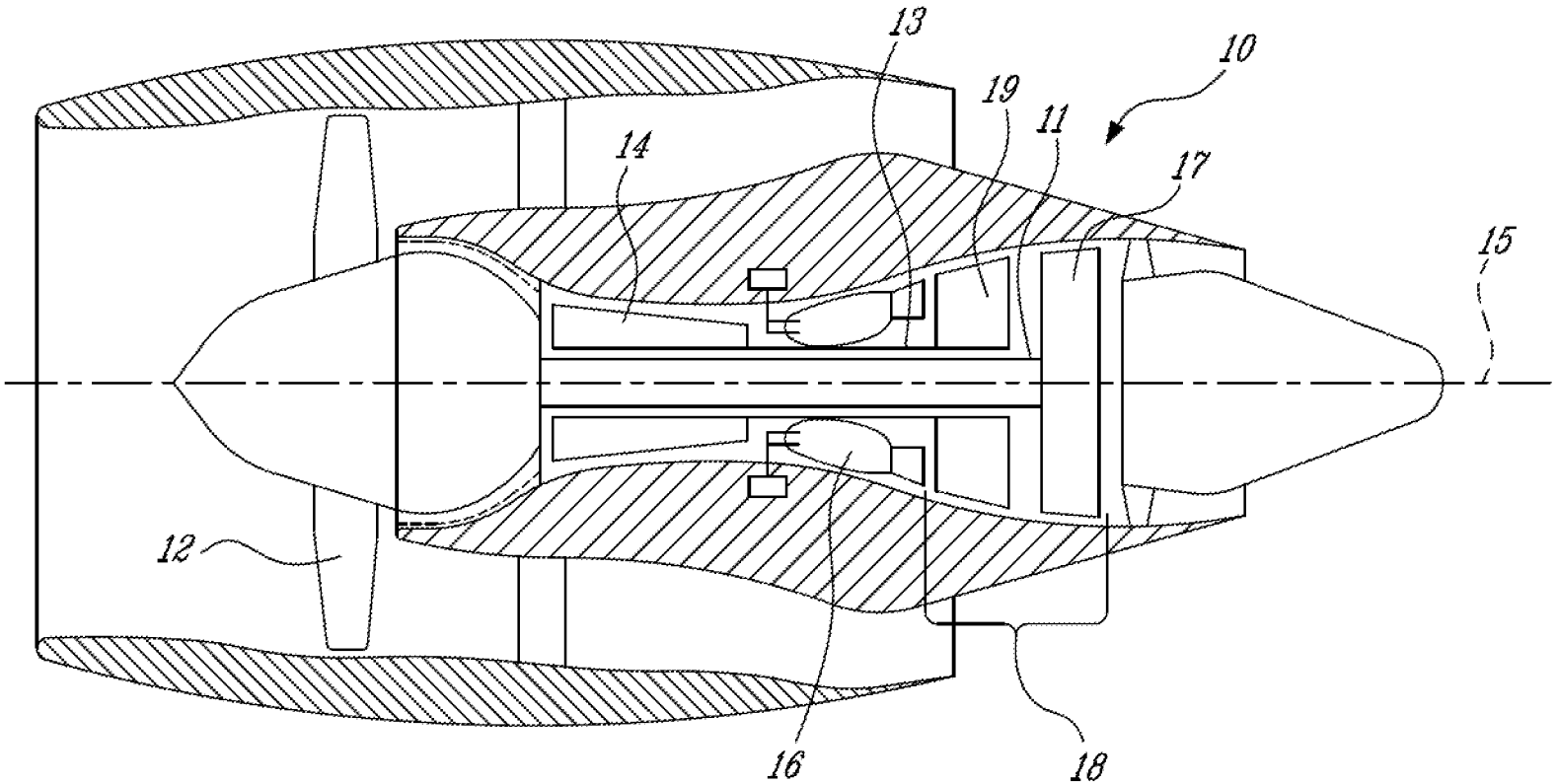
FIG. 1 is schematic cross-section of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

In the depicted embodiment, the turbine section 18 comprises a low pressure turbine 17 and a high pressure turbine 19. The engine 10 also preferably includes at least two rotating main engine shafts, namely a first inner shaft 11 interconnecting the fan 12 with the low pressure turbine 17, and a second outer shaft 13 interconnecting the compressor 14 with the high pressure turbine 19. The inner and outer main engine shafts 11 and 13 are concentric and rotate about the centerline axis 15 which is preferably collinear with their longitudinal axes.

The main engine shafts 11, 13 are supported at a plurality of points by bearings, and extend through several engine cavities. As such, a number of shaft seals are provided to ensure sealing about the shafts at several points along their length to prevent unwanted fluid leaking from one engine compartment or cavity. For example, compressed air in the main engine gas path must be kept separate from the secondary cooling air or bearing lubrication oil in bearing cavities and cooling cavities adjacent to the main engine gas path.

Figure 2:
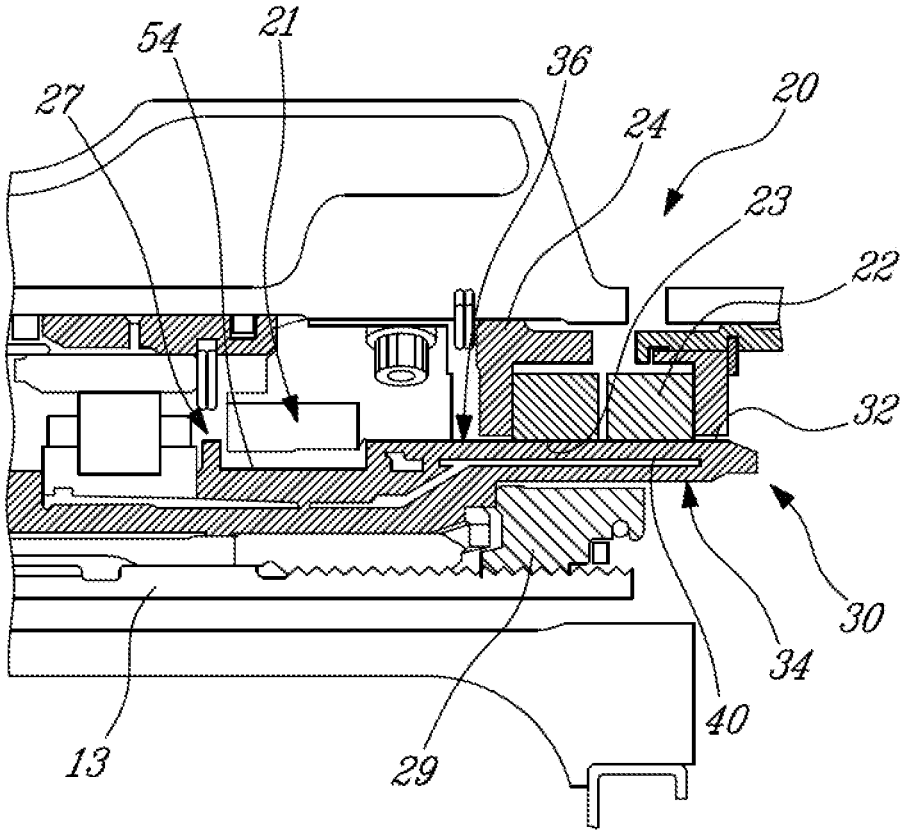
FIG. 2 is a partial cross-sectional view of a contact seal assembly in accordance with the present disclosure for sealing a rotating engine shaft of the gas turbine engine of FIG. 1, the contact seal assembly including a carbon ring assembly and an associated seal runner.

Referring now to FIG. 2, at least one of the shaft seals used to seal the rotating shaft 11 and/or 13 in the engine 10 is a contact seal 20, as will now be described in further detail. The contact seal 20 includes generally a number of rotationally stationary carbon ring segments 22 which together form at least one circumferentially interrupted annular carbon ring assembly and a rotating seal runner 30 connected to one of the rotating engine shafts of the gas turbine engine 10 (such as the shaft 13 for example) and rotatable relative to the carbon ring 22. The carbon ring segments 22 are arcuate carbon segments circumferentially arranged within the seal housing 24, the housing 24 being in turn fastened in fixed position to a supporting engine support and/or casing segment 25. Further, as seen in FIG. 2, the carbon ring segments 22 may include a pair of axially spaced segmented annular carbon rings assemblies.

Referring still to FIG. 2, the annular seal runner 30 is located adjacent to and radially inwardly from the carbon ring segments 22 to thereby create a rotating contact interface between the carbon ring segments 22 and the rotating seal runner 30, to form a substantially fluid tight seal therebetween when the engine shaft 13 rotates during operation of the engine 10. More particularly, a radially outer surface 32 of the seal runner 30 contacts the radially inner surfaces 23 of the carbon ring segments 22. As will be seen, the seal runner 30 is internally cooled, in that the radially outer contact surface 32 of the seal runner does not require external spray cooling but rather is cooled from within by circulating the cooling fluid (such as, but not necessarily, oil) internally within the fluid passage 40 formed within the seal runner 30. The cooling oil is distributed to the seal runner via one or more oil nozzles 21 which feed the cooling oil radially inwardly onto the circumferentially extending open topped channel 54 disposed at a forward end 27 of the seal runner 30.

Figure 3:
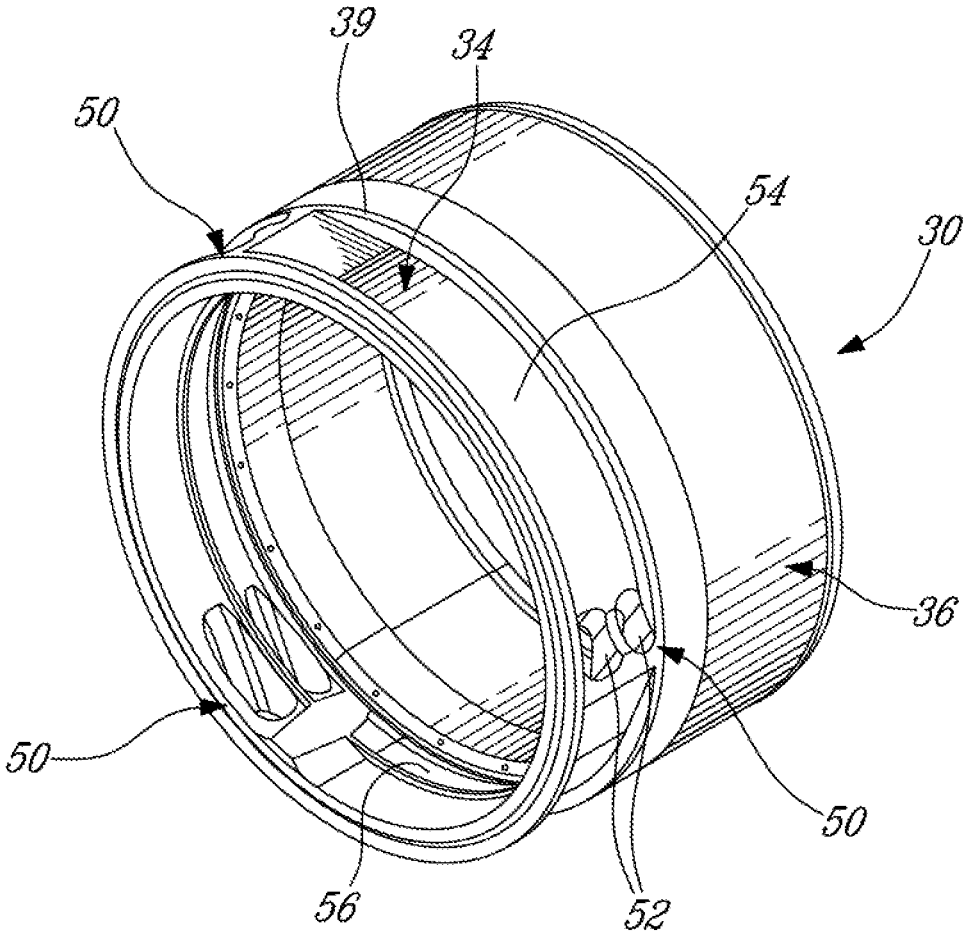
FIG. 3 is a perspective view of the seal runner of the contact seal assembly of FIG. 2.
Figure 4:
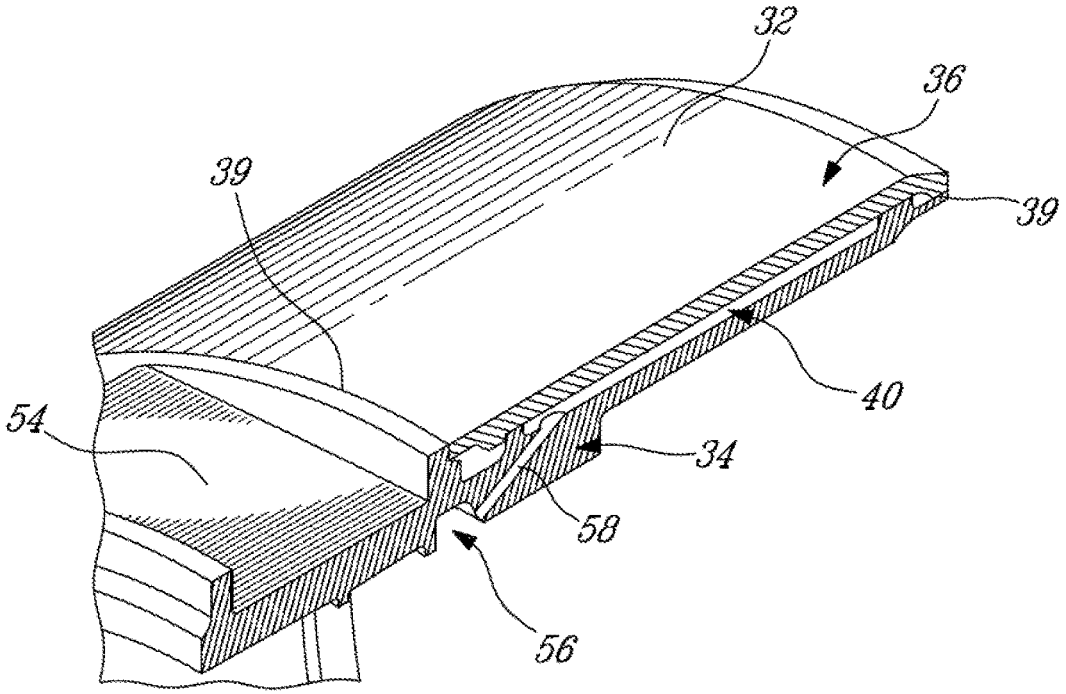
FIG. 4 is a partial cross-sectional perspective view of the seal runner of FIG. 3, taken through a fluid inlet.
Figure 5:
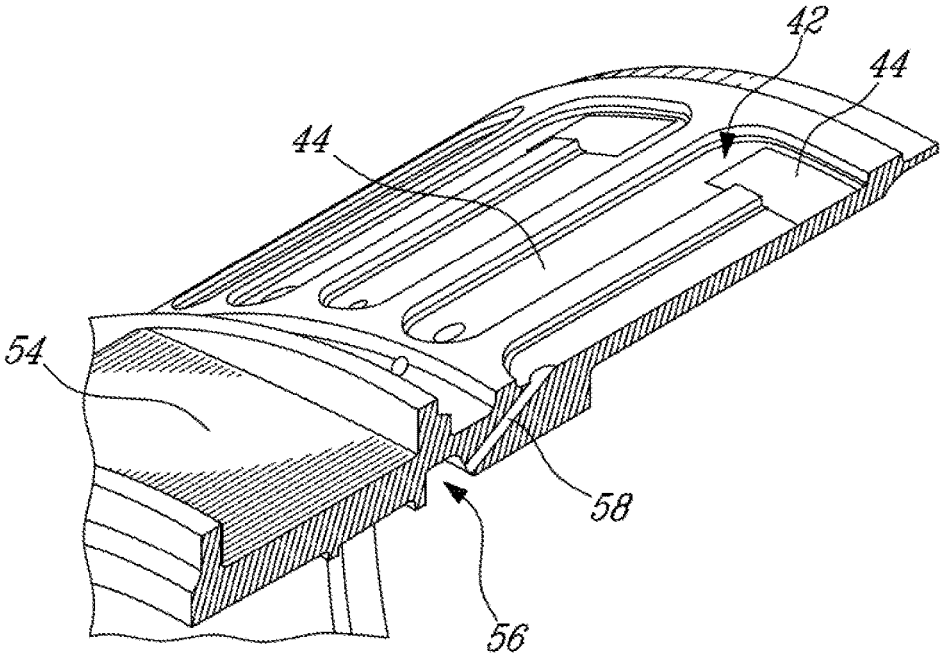
FIG. 5 is a partial cross-sectional perspective view of the seal runner of FIG. 4, shown with an outer annular portion thereof removed to depict only an inner annular portion thereof.

As seen in FIGS. 3-5, the seal runner 30 comprises first and second annular portions 34 and 36 which are concentric with one another, at least partially axially overlapping, and radially spaced apart wherein the second annular portion 36 is radially outwardly disposed from the inner first annular portion 34 such as to define an annular fluid passage 40 therebetween, as will be described further below.

The seal runner 30 may be either formed in a number of different manners, and may comprise one, two or more separate components which together form the present seal runner 30. For example, in one embodiment the seal runner 30 may be formed using a three-dimensional printing production technique, whereby the seal runner 30 is integrally formed of a single piece (i.e. is monolithic). In another possible embodiment of the present disclosure, the seal runner 30 is composed of two or more portions, which are separately formed and engaged or otherwise assembled together to form the finished seal runner 30. In this embodiment, for example, the first and second annular portions 34 and 36 are separately formed and mated together with the outer, second annular portion 36 radially outwardly spaced from the inner, first annular portion 34. The outer, or second, annular portion 36 in this case forms an outer runner sleeve which fits over the smaller diameter inner, or first, annular portion 34. The radially inner first annular portion 34 and the radially outer second annular portion 36 are, in this embodiment, separately formed and engaged together in radial superposition to form the seal runner 30, making it a two-part seal runner. More than two components may also be used to form the inner and outer annular portions 34, 36, thereby making it a multi-part seal runner. While the outer runner sleeve 36 may be engaged to the inner annular portion 34 by a number of suitable means, in at least one embodiment the two components of the seal runner 30 are welded together, for example at two axial weld points 39 (see FIGS. 4 and 7). These welds 39 may be annular, or at least extend partially about the circumference of the joints between the inner and outer portions 34, 36 of the seal runner and disposed at the forward and rearward ends of the outer sleeve portion 36. Although welds may be used to engage the components of the seal runner 30 together, other suitable engagements means may also be used, such as for example only, brazing, bonding, adhering, fastening, etc.

As noted above, at least one fluid passage 40 is radially defined between the first and second annular portions 34, 36, into which cooling oil is fed to cool the seal runner 30 in general, and the hot radially outer second annular portion 34 having the outer contact surface 32 thereon in particular. Accordingly, the fluid passage 40 is internally formed within the seal runner 30 such that the seal runner 30 is cooled from within. Cooling oil within the fluid passage 40 will be forced radially outward by centrifugal force, thereby ensuring that the cooling oil is maintained in contact with the inner surface of the hot outer sleeve portion 36, which defines the contact surface on the opposed radially outer surface for rubbing against the carbon ring segments 22. Thus, the underside of the runner surface is cooled internally, by absorbing the heat therefrom using the circulating oil flow. Further, the centrifugal force of the shaft rotating will also generate pumping of the cooling oil, using the integrated oil scoops 50 as will be described below.

Figure 6:
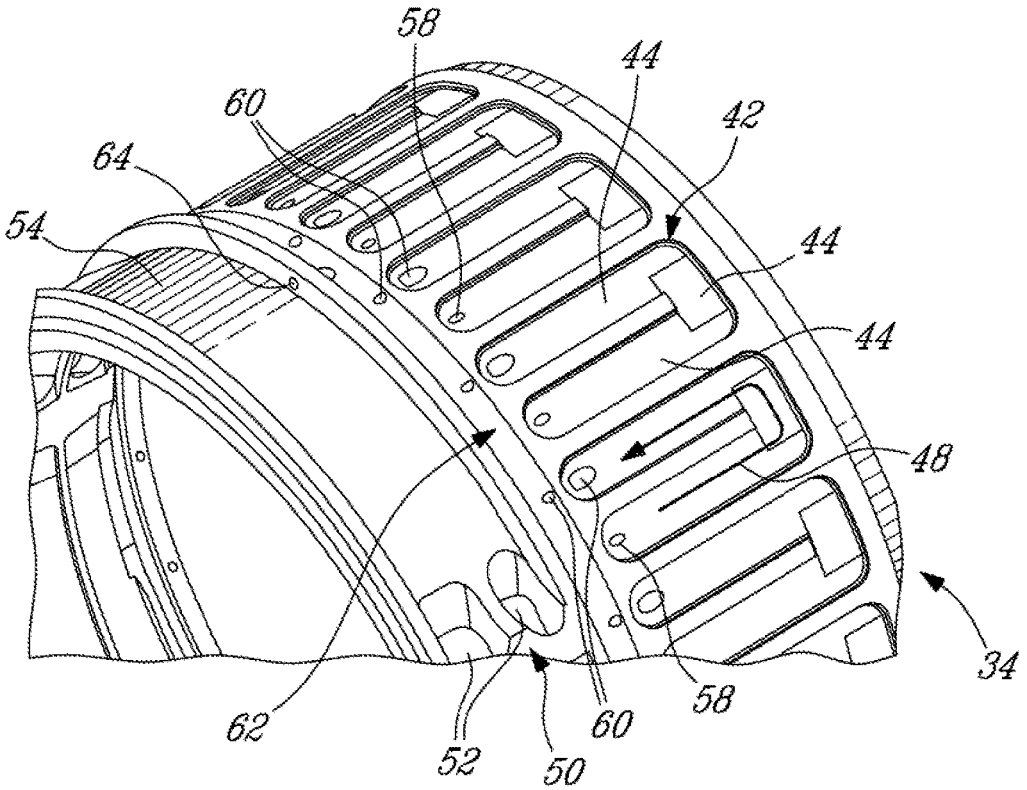
FIG. 6 is a partial perspective view of the inner annular portion of the seal runner of FIG. 5.

As best seen in FIGS. 5-6, the internal fluid passage 40 within the seal runner 30 is formed by at least one radially-open channel 42 defined in one or both of the first and second annular portions 34, 36, such as in the radially inner first annular portion 34 for example. As such, when the two annular portions 34 and 36 of the seal runner 30 are concentrically aligned and mated together, the radially inwardly facing surface of the outer second annular portion 36 encloses the open topped channel 42 to form the enclosed fluid passage 40. The channel 42, and consequently the enclosed internal fluid passage 40, is composed of a plurality of serially interconnected passage segments 44 which intersect each other to define a tortuous fluid flow path through the fluid passage. The radially inner surfaces of the serially interconnected passage segments are disposed at a common diameter within the seal runner. In one particular embodiment the segments 44 of the channel 42 define a substantially serpentine shape, however other configurations and shapes of the channel(s) 42 may also be provided. In all cases, the tortuous path formed by the channel or channels 42 causes the cooling oil that is circulated through the fluid passage 40 formed by the channel 42 to more effectively cool the seal runner 30.

As seen in FIGS. 3 and 6, the seal runner 30 also includes at least one integrated oil scoop 50 that is integrally formed in the radially inner first annular portion 34 of the seal runner 30, forward of the seal runner surface 32 of the second annular sleeve portion 36. In the depicted embodiment, the seal runner 30 in fact includes three oil scoops 50 which are substantially equally circumferentially spaced apart about the inner annular portion 34 of the seal runner 30. Each of the oil scoops 50 are disposed in fluid flow communication with the internal fluid passage 40 within the seal runner 30, and more particularly the oil scoops 50 collect and feed the cooling oil into the fluid passage 40 such as to internally cool the seal runner during operation of the engine.

As seen in FIGS. 3 and 6, each of the oil scoops 50 may include a pair of openings 52 which extend radially inwardly through the first annular portion 34 of the seal runner 30 in a direction of rotation of the seal runner. The openings 52 of each of the oil scoops 50 are disposed at an angle such that rotation of the seal runner 30 causes oil within the radially open topped annular scoop channel 54 in the upstream end of the first portion 34 of the seal runner 30 to be scooped up and forced radially inwardly through the openings 52 of the oil scoops 50.

As best seen in FIGS. 4-6, cooling oil that is collected by the oil scoops 50 and forced inwardly through the scoop openings 52 is directed into an annular distribution channel 56, which is formed in the radially inner surface of the first portion 34 of the seal runner 30 and is radially inwardly open. The oil or other cooling fluid used will therefore collect in this annular distribution channel 56 during operation of the engine, as a result of the centripetal forces acting on the fluid. A plurality of angled entry holes 58 extend radially outwardly from the inner distribution channel 56, and permit fluid flow from the annular distribution channel 56 into the tortuously shaped internal fluid passage 40, formed between the first and second portions 34, 36 of the seal runner 30 as described above.

Figure 9:
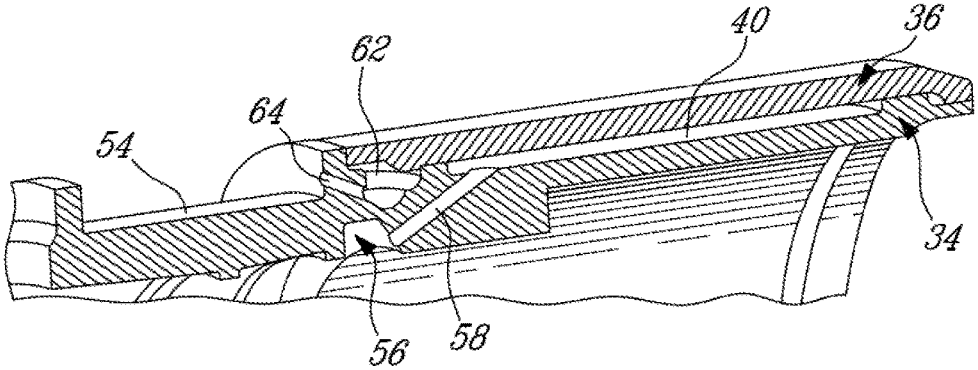
FIG. 9 is a partial cross-sectional view of the seal runner, taken through both the fluid inlet and a fluid exit.

Referring briefly to FIG. 9, the entry holes 58 may, in one possible embodiment, permit greater fluid flow therethrough than do the exit holes 64. This may be accomplished, for example, by forming the entry holes 58 having greater diameters than the diameters of the exit holes 64. Alternately or in addition, there may be substantially more entry holes 58 provided than exit holes 64. The fluid flow rate through the seal runner 30 is therefore able to be controlled as desired, by selecting the number, configuration and geometry of the entry and exit holes or openings. In one particular embodiment, more than 6 times the number of entry holes than exit holes are provided, and the diameter of the inlet holes is greater than that of the exit holes, for example each of the exit holes is less than ¾ the diameter of each of the inlet holes.

Figure 7:
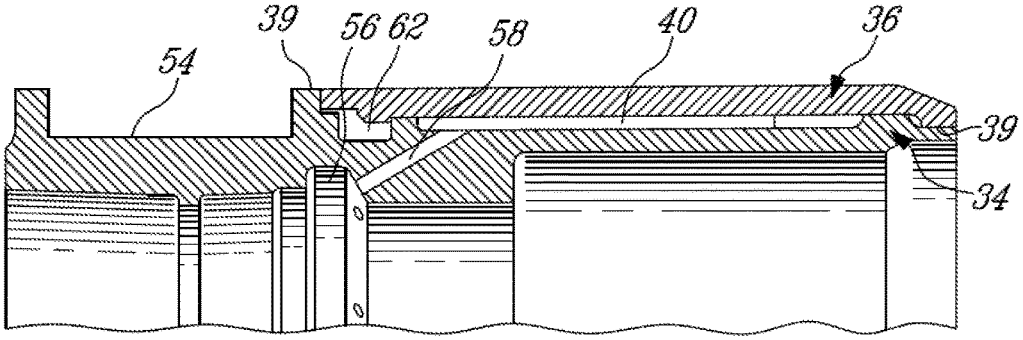
FIG. 7 is a partial cross-sectional view of the seal runner of FIG. 4.
Figure 8:
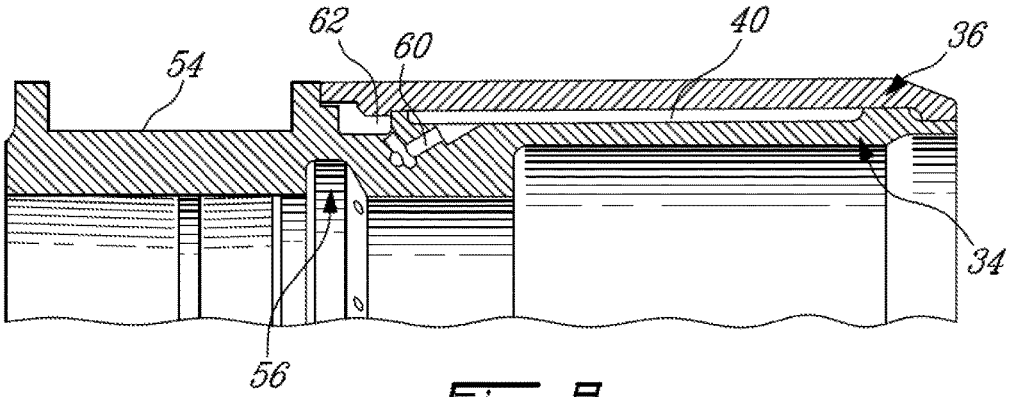
FIG. 8 is a partial cross-sectional view of the seal runner, taken through a fluid exit from the internal seal runner fluid passage.

As can be seen in FIGS. 7-9, while the internal fluid passage 40 of the seal runner 30 may have a tortuous flow path as shown in FIGS. 7-8, the fluid passage 40 is axially elongated and extends axially between the inner and outer portions 34, 36 of the seal runner 30 along at least a major portion of the axially overlapping length between the inner and outer portions 34 and 36. The entire fluid passage 40 is accordingly annular in shape, extending circumferentially about the seal runner 30 between the inner and outer portions 34 and 36 thereof. When seen in cross-section as shown in FIGS. 9-11, the fluid passage 40 may axially extend in a direction that is substantially parallel to, and concentric with, an axis of rotation 15 of the engine shaft 13 and thus the axis of rotation of the annular seal runner 30 that is fixed to the shaft.

Once the cooling fluid (ex: oil, or otherwise) enters the internal fluid passage of the seal runner 30 via the entry holes 58 as described above, the cooling fluid then flows through the tortuous flow path 48 as shown in FIG. 6, i.e. through the serially connected serpentine channel segments 44 which make up the channel 42. This flow of cooling fluid through the internal fluid passage 40 according acts to cool the seal runner 30 from the inside, thereby cooling the hotter outer portion 36 of the rotating seal runner 30 having the radially outer surface 32 thereon which defines the rubbing contact interface with the carbon ring segments 22 of the contact seal assembly 20. This internal cooling of the seal runner 30 may therefore avoid the need for external spray cooling, thereby simplifying the cooling oil nozzle placement and enabling a more compact contact seal assembly 20.

As seen in FIGS. 6 and 8, once the cooling fluid has circulated through the internal fluid passage 40 along the tortuous flow path 48 therewithin, the fluid exits the fluid passage 40 via exit passages 60 which communicate with an radially outwardly opening channel 62 formed in the outer surface of the first annular portion 34 of the seal runner 30. Cooling fluid within this annular channel 62 is then able to circumferentially circulate between the inner and outer portions 34, 36 of the seal runner 30 thereby providing further cooling prior to being ejected out from between the two portions 34, 36 of the seal runner 30, and back into the open channel 43 for subsequent recirculation, via outlet holes 64 (see FIGS. 6 and 9).

The contact seal assembly as described herein is believed to provide an improved shaft seal adapted for use in a gas turbine engine, however the present contact seal may also be used for other shaft sealing applications. For example only, high speed pumps and compressors used in high speed, high temperature and/or severe service conditions represent other applications in which the present rotating shaft seal may prove viable. The present contact seal and seal runner may be particularly useful in applications when space is limited and/or enables the seal runner to be cooled even when there is no access to the underside of the seal runner directly. Thus, cooling fluid nozzles and related configurations may be able to be simplified, thereby potentially saving space, weight and/or cost.

When used in a gas turbine engine 10 such as that depicted in FIG. 1, the present contact seal assembly 20 may be disposed about any rotating shaft or other element thereof, such as for example about at least one of the main engine shafts 11 and 13. Alternately, the contact seal assembly 20 may be employed to seal another rotating shaft in the gas turbine engine 10 or in another turbomachine, pump, compressor, turbocharger or the like. The seal runner 30 of the present contact seal assembly 20 preferably integrally formed therewith. The seal runner 30 may be mounted to the shaft using any suitable means, such as by using a threaded stack nut 29 which fastens the seal runner in place about the shaft 13, as shown in FIG. 2. Regardless, the seal runner 30 is rotationally fixed in place to the shaft 13, such that it rotates within the carbon ring segments 22 and remains in contact therewith when the shaft 13 rotates. Thus, the contact seal assembly 20 provides a fluid seal about the rotating shaft.

The above description is meant to be exemplary only, and one skilled in the art will recognize that changes may be made to the embodiments described without department from the scope of the invention disclosed. Still other modifications which fall within the scope of the present invention will be apparent to those skilled in the art, in light of a review of this disclosure, and such modifications are intended to fall within the appended claims.

The invention claimed is:

1. A contact seal assembly for a shaft of a gas turbine engine, comprising:

one or more carbon ring segments mounted in a fixed position within a housing; and an annular seal runner adapted to be connected to the shaft of the gas turbine engine and rotatable relative to the carbon ring segments, the seal runner being disposed adjacent to and radially inwardly from the carbon ring segments and abutting thereagainst during rotation of the seal runner to form a contact interface between the seal runner and the carbon ring segments which forms a substantially fluid tight seal;

the seal runner comprising concentric inner and outer annular portions which are radially spaced apart to define therebetween at least one internal fluid passage, said internal fluid passage formed by serially interconnected passage segments which intersect each other to create a single tortuous fluid flow path through the internal fluid passage, radially inner surfaces defined by the serially interconnected passage segments and said single tortuous fluid flow path defined thereby being disposed at a single radial position between the inner and outer annular portions of the seal runner such that all of the radially inner surfaces of the serially interconnected passage segments are disposed at a common diameter within the seal runner, the internal fluid passage being adapted to receive cooling oil therein for cooling the seal runner from within, and the seal runner having one or more oil scoops integrally formed in one of the inner and outer annular portions and disposed in fluid flow communication with the internal fluid passage, the one or more oil scoops feeding cooling oil into said internal fluid passage.

2. The contact seal assembly as defined in claim 1, wherein the inner and outer annular portions of the seal runner are separately formed and engaged together.

3. The contact seal assembly as defined in claim 2, wherein the outer annular portion defines a sleeve which fits over the inner annular portion and axially overlaps only a portion of the axially longer inner annular portion.

4. The contact seal assembly as defined in claim 3, wherein the internal fluid passage extends axially between the inner and outer annular portions of the seal runner along at least a major portion of the axially overlapping length between the inner and outer annular portions.

5. The contact seal assembly as defined in claim 2, wherein said fluid passage is formed by at least one radially-open channel provided in at least one of the first and second annular portions.

6. The contact seal assembly as defined in claim 2, wherein the inner and outer annular portions of the seal runner are welded together at axial outer ends of the outer annular portion.

7. The contact seal assembly as defined in claim 1, wherein multiple oil scoops are disposed in the inner annular portion of the seal runner, the oil scoops being substantially equally circumferentially spaced apart thereabout.

8. The contact seal assembly as defined in claim 7, wherein the oil scoops each comprises at least one opening which radially extends through the inner annular portion of the seal runner.

9. The contact seal assembly as defined in claim 1, wherein each of the oil scoops comprises a pair of openings radially extending through the inner annular portion and angled radially inwardly in a direction of rotation, to collect and force oil radially inwardly into an annular distribution channel formed in the radially inner surfaces.

10. The contact seal assembly as defined in claim 1, wherein the internal fluid passage axially extends in a direction which is substantially parallel to and concentric with an axis of rotation of the seal runner.

11. The contact seal assembly as defined in claim 1, wherein the fluid passage defines a serpentine shape.

12. The contact seal assembly as defined in claim 1, wherein entry holes permit fluid inlet flow from the oil scoops to the fluid passage and exit holes permit fluid outlet flow from the fluid passage to outside the seal runner, wherein the entry holes provide greater fluid flow therethrough than the exit holes.

13. The contact seal assembly as defined in claim 12, wherein the number of entry holes is greater than the number of exit holes.

14. The contact seal assembly as defined in claim 13, wherein the number of the entry holes is more than six times the number of the exit holes.

15. The contact seal assembly as defined in claim 12, wherein a diameter of the entry holes is greater than that of the exit holes.

16. The contact seal assembly as defined in claim 15, wherein the diameter of the exit holes is less than ¾ of the diameter of the entry holes.

17. A gas turbine engine comprising one or more compressors, a combustor and one or more turbines, at least one of said compressors and at least one of said turbines being interconnected by an engine shaft rotating about a longitudinal axis thereof, at least one contact shaft seal being disposed about the rotating engine shaft to provide a fluid seal therewith, the contact shaft seal comprising one or more carbon ring assemblies having carbon ring segments mounted in a fixed position within a housing and an annular seal runner fixed to the engine shaft for rotation within the carbon ring assemblies, the seal runner abutting the carbon ring segments during rotation of the seal runner to form a contact interface therebetween which forms a substantially fluid tight shaft seal, the seal runner having concentric inner and outer annular portions which are radially spaced apart to define therebetween at least one internal fluid passage enclosed within the seal runner, the internal fluid passage formed by serially interconnected passage segments which intersect each other to create a tortuous fluid flow path through the internal fluid passage, radially inner surfaces defined by the passage segments and the single tortuous fluid flow path defined being disposed at a single radial position between the inner and outer annular portions of the seal runner such that the radially inner surfaces of the passage segments are all disposed at a common diameter within the seal runner, the internal fluid passage receiving cooling oil therein for cooling the seal runner from within, the seal runner having one or more oil scoops integrally formed in one of the inner and outer annular portions and disposed in fluid flow communication with the internal fluid passage to feed the cooling oil into said internal fluid passage.

* * * * *